US006570436B1

(12) United States Patent
Kronmueller et al.

(10) Patent No.: US 6,570,436 B1
(45) Date of Patent: May 27, 2003

(54) THRESHOLD VOLTAGE-INDEPENDENT MOS CURRENT REFERENCE

(75) Inventors: Frank Kronmueller, Neudenau (DE); Horst Knoedgen, Munich (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 0 days.

(21) Appl. No.: 10/002,982

(22) Filed: Nov. 30, 2001

(30) Foreign Application Priority Data

Nov. 14, 2001 (EP) ..... 01640008

(51) Int. Cl.[7] ..... G05F 1/10

(52) U.S. Cl. ..... 327/538; 327/540; 327/541; 323/315; 323/316

(58) Field of Search ..... 327/538, 540, 327/541, 542, 543; 323/312, 313, 314, 315, 316

(56) References Cited

U.S. PATENT DOCUMENTS 4,723,108 A 2/1988 Murphy et al. ..... 323/315
5,043,652 A * 8/1991 Ribicki et al. ..... 323/316
5,315,230 A 5/1994 Cordoba et al. ..... 323/313
5,739,682 A 4/1998 Kay ..... 323/315
5,910,749 A 6/1999 Kimura ..... 327/541
6,054,874 A * 4/2000 Sculley et al. ..... 326/83
6,362,613 B1 * 3/2002 Rodriguez ..... 323/315

* cited by examiner

*Primary Examiner*—Tuan T. Lam
*Assistant Examiner*—Hiep Nguyen
(74) *Attorney, Agent, or Firm*—George O. Saile; Stephen B. Ackerman; Douglas R. Schnabel

(57) ABSTRACT

A new current reference circuit is achieved. This current reference circuit is based on MOS transistors but does not depend upon the threshold voltage. The circuit comprises, first, a first MOS transistor having gate, drain, and source. A gate voltage value is coupled from the gate to the source. A second MOS transistor has gate, drain, and source. The second MOS transistor is of the same size and type as the first MOS transistor. The source is coupled to said first MOS transistor source. The gate voltage value plus a delta voltage value is coupled from the gate to the source. A means is provided for forcing a drain voltage value from the drain to the source of the first MOS transistor and from the drain to the source of the second MOS transistor. The first MOS transistor and the second MOS transistor conduct drain currents in the linear mode. Finally, a means is provided for subtracting the first MOS transistor drain current from the second MOS transistor drain current to thereby create a current reference value. The current reference value does not depend upon the threshold voltage of the first and second MOS transistors. The circuit may be further applied to create a nearly zero temperature coefficient current reference.

12 Claims, 6 Drawing Sheets

THRESHOLD VOLTAGE-INDEPENDENT MOS CURRENT REFERENCE

BACKGROUND OF THE INVENTION (1) Field of the Invention

The invention relates to a current reference circuit, and more particularly, to a threshold voltage-independent MOS current reference circuit.

(2) Description of the Prior Art

Current and voltage reference circuits are widely used in analog designs. A particularly difficult problem encountered in MOS reference circuit designs is caused by the large variation in threshold voltage ($V_{th}$) that often occurs in CMOS processing. Since the voltage-to-current transfer response of the MOS transistor depends on the value of $V_{th}$, large variations in $V_{th}$ can cause large variations in the actual current or voltage output of the reference circuit. It is desirable, therefore to eliminate $V_{th}$ dependence in the reference output.

However, prior art attempts to eliminate the $V_{th}$ component typically rely on complicated voltage addition techniques to create a $V_x+V_{th}$. These techniques create several problems due to the use of differing operation points, or modes, for different MOS devices. Therefore, mismatch problems are a major drawback.

Several prior art inventions describe voltage or current reference circuits. U.S. Pat. No. 5,739,682 to Kay describes a reference substantially independent of the threshold voltage of the transistor providing the reference. A pair of MOS transistors has gate voltages made equal. The current through the first transistor is very small. The current through the second transistor is equal to the first current multiplied by a scaling factor. Since the first current is so small, the second current through the second transistor is essentially not dependent upon the threshold voltage. U.S. Pat. No. 5,910,749 to Kimura teaches a current reference with no temperature dependence. Both bipolar and MOS embodiments are disclosed. U.S. Pat. No. 4,723,108 to Murphy et al describes a circuit to compensate for MOS transistor performance changing over temperature and manufacturing variation. Changing Vth, caused by temperature, is compensated by changing the mobility in the opposite direction. The gate drive of a MOS device is thereby compensated. U.S. Pat. No. 5,315,230 to Cordoba et al teaches a reference voltage generator circuit that compensates for temperature and VCC variation.

SUMMARY OF THE INVENTION

A principal object of the present invention is to provide an effective and very manufacturable current reference circuit.

A further object of the present invention is to provide a current reference circuit comprising MOS devices.

A still further object of the present invention is to provide an MOS current reference circuit that is independent of the threshold voltage to thereby reduce reference current variation due to processing variation.

Another still further object of the present invention is to provide a nearly zero temperature coefficient current references using this novel MOS current reference circuit.

In accordance with the objects of this invention, a new current reference circuit is achieved. This current reference circuit uses MOS transistors. However, the reference value does not depend upon the threshold voltage. The circuit comprises, first, a first MOS transistor having gate, drain, and source. A gate voltage value is coupled from the gate to the source. A second MOS transistor has gate, drain, and source. The second MOS transistor is of the same size and type as the first MOS transistor. The source is coupled to the first MOS transistor source. The gate voltage value plus a delta voltage value is coupled from the gate to the source. A means is provided for forcing a drain voltage value from the drain to the source of the first MOS transistor and from the drain to the source of the second MOS transistor. The first MOS transistor and the second MOS transistor conduct drain currents in the linear mode. Finally, a means is provided for subtracting the first MOS transistor drain current from the second MOS transistor drain current to thereby create a current reference value. The current reference value does not depend upon the threshold voltage of the first and second MOS transistors. The circuit may be further applied to create a nearly zero temperature coefficient current reference.

BRIEF DESCRIPTION OF THE DRAWINGS

In the accompanying drawings forming a material part of this description, there is shown.

DESCRIPTION OF THE PREFERRED EMBODIMENTS

The preferred embodiments disclose the novel current reference circuit of the present invention. In the first embodiment, a matched pair of NMOS transistors is used to create the threshold voltage-independent current reference. In the second preferred embodiment, a matched pair of PMOS transistors is used in an inverted version of the present invention. Finally, the invention is applied to a near zero temperature coefficient (TC) current reference. It should be clear to those experienced in the art that the present invention can be applied and extended without deviating from the scope of the present invention.

Figure 1:
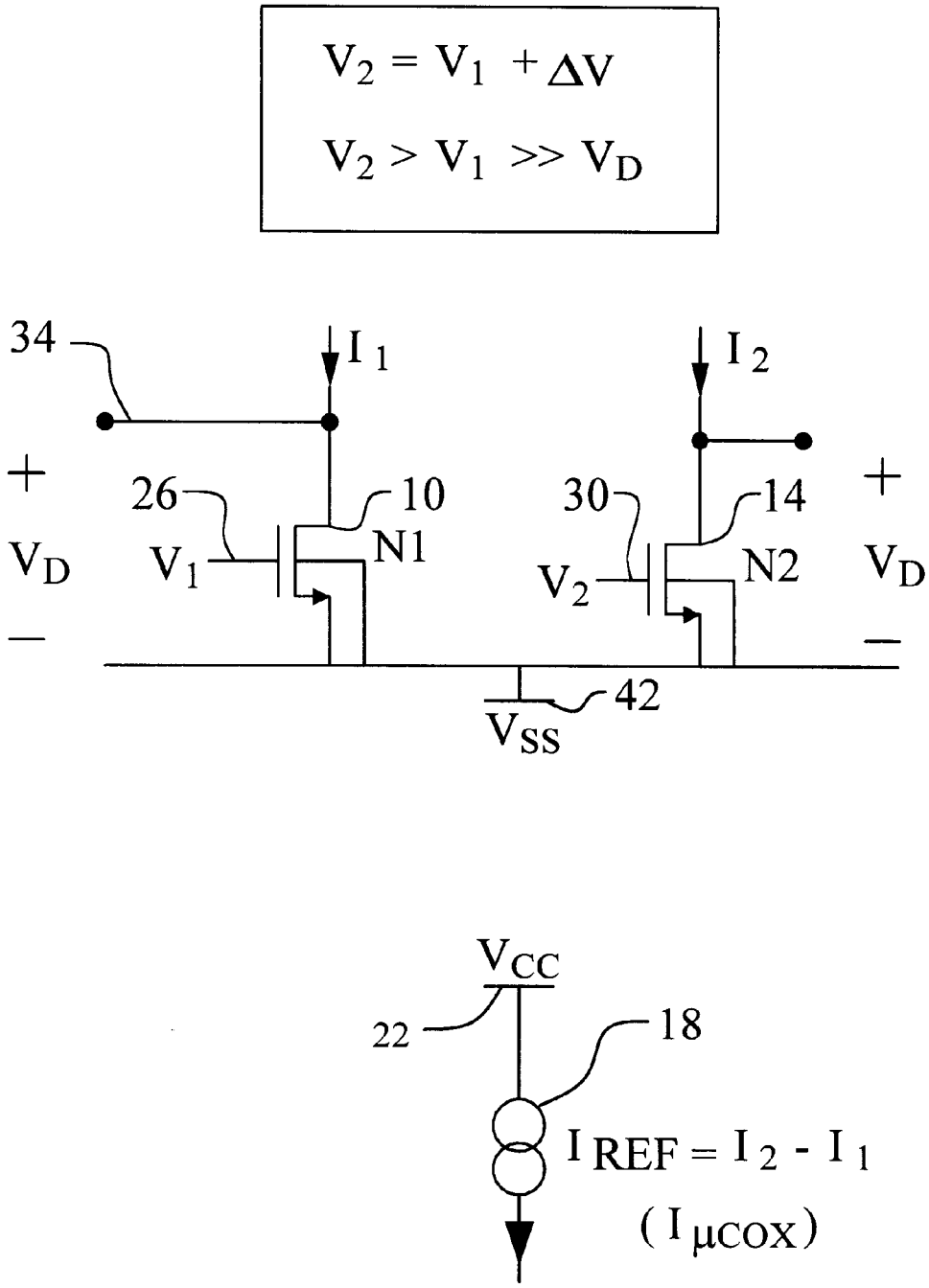
FIG. 1 illustrates a first preferred embodiment of the present invention.

Referring now to FIG. 1, a first preferred embodiment of the present invention is illustrated. Several important features of the invention are shown. The circuit comprises a matching pair of MOS transistors, N1 10 and N2 14. Each transistor, N1 10 and N2 14, is of the same type and size, and more preferably, is oriented in the same layout direction. Even though the novel technique of the invention eliminates $V_{th}$ from the current reference final value, other parameters, such as mobility, or $\mu_o$, and gate capacitance, $C_{ox}$, should still be made to match as closely a possible between the two transistors. A significant advantage of the present invention is the elimination of the $V_{th}$ dependence in the current reference. By comparison, $\mu_o$ and $C_{ox}$ process variance is found to be much less than that of $V_{th}$.

The first MOS transistor, N1 10, has a gate voltage value, $V_1$ 26, coupled from the gate to the source. The second MOS transistor, N2 14, has the source coupled to the first MOS transistor source at the $V_{SS}$ node 42. A second gate voltage value, $V_2$ 30, is coupled from the gate to the source of N2 14. The second gate voltage value, $V_2$ 30, comprises the first gate voltage value, $V_1$ 26, plus a delta voltage value, ΔV.

A means is provided for forcing a drain voltage value, $V_D$ 34 and 38, from the drain to the source of the first MOS transistor, N1 10, and from the drain to the source of the second MOS transistor, N2 14. Most importantly, both transistors, 10 and 14, are biased to operate in the linear mode. To insure that both devices are in the linear mode, the gate voltages, $V_1$ 26 and $V_2$ 30, are much larger than the drain voltage, $V_D$ 34 and 38. In the linear mode, a direct relationship exists between the gate voltage and the drain current as given by:

$$I_D=(\mu_o C_{ox} W/L)(V_G-V_{th}-V_D/2)V_D,$$

where W/L is the width to length ratio. In this mode, the gate voltages must be larger than the threshold voltage to insure that both transistors are in strong inversion. The first MOS transistor, N1 10, generates a current, $I_1$. The second MOS transistor, N2 14, generates a current, $I_2$.

Finally, a means, 18, is provided for subtracting the first MOS transistor N1 10 drain current $I_1$ from the second MOS transistor N2 14 drain current $I_2$ to thereby create a current reference value, $I_{REF}$. The subtracting means 18 creates the current reference output, $I_{REF}$, where $I_{REF}=I_2-I_1$.

Substituting the gate and drain voltage values into the linear mode drain current equation, we find:

$$I_1=(\mu_o C_{ox} W/L)(V_1-V_{th}-V_D/2)V_D,$$

and $$I_2=(\mu_o C_{ox} W/L)(V_1+\Delta V-V_{th}-V_D/2)V_D.$$

Since, $I_{REF}=I_2-I_1$, we can solve the drain equations for $I_{REF}$, yielding:

$$I_{REF}=(\mu_o C_{ox} W/L)(\Delta V)V_D.$$

We note from this result that the $V_{th}$ term has been canceled. Therefore, the resulting current reference value does not depend on the threshold voltage. Since the resulting reference does still depend upon both mobility and gate capacitance, $I_{REF}$ is also called $I_{\mu Cox}$.

Figure 2:
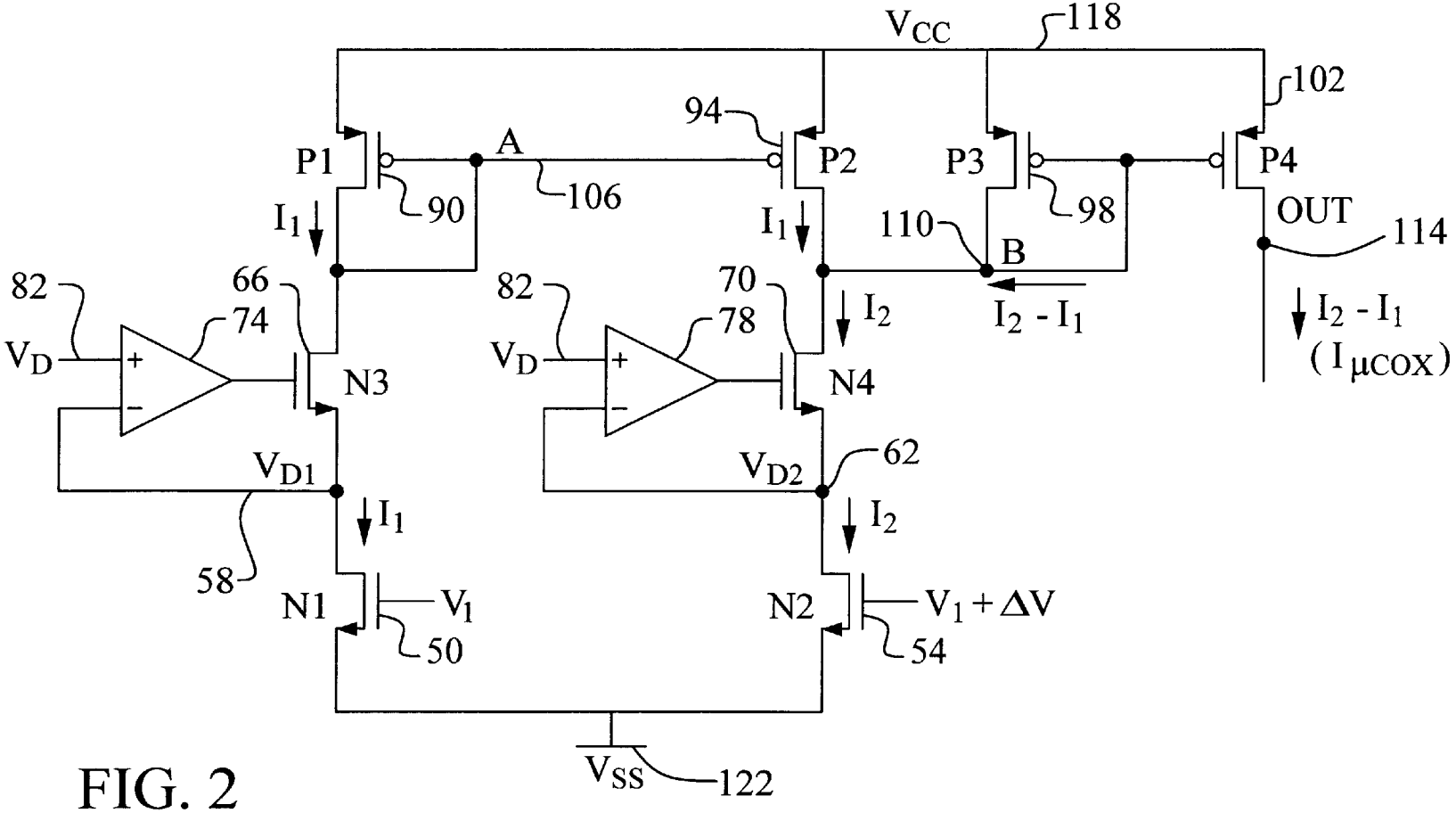
FIG. 2 illustrates a first preferred embodiment of the present invention, using NMOS transistors, including a means of forcing a drain voltage and a means of subtracting the drain currents to thereby create the current reference.

Referring now to FIG. 2, the first preferred embodiment is illustrated in greater detail to show a realized circuit implementation of the invention concept. The matched NMOS transistor pair comprises N1 50 and N2 54. Once again, the sources of N1 and N2 are coupled together while the gates are coupled to $V_1$ and $V_1+\Delta V$ such that the gate drive differs by the delta voltage, ΔV. The gate voltages, $V_1$ and $V_1+\Delta V$, are biased much higher than the drain voltage, $V_D$, so that the MOS devices are operating in the linear mode.

The means to force the drain voltage value, $V_D$ 34 and 38, from the drain to the source of both N1 and N2 14 is provided by two voltage followers comprising the operation amplifiers 74 and 78 and the output transistors, N3 66 and N4 70. Due to the large input impedance and the high gain of the operation amplifiers 74 and 78, the drain voltages, $V_{D1}$ and $V_{D2}$ are guaranteed to be driven to the reference drain voltage value, $V_D$ 82. Further, the voltage follower arrangement isolates the drain reference voltage, $V_D$, from the actual drains of the first and second MOS transistors, N1 50 and N2 54.

The means for subtracting the drain currents, $I_1$ and $I_2$, is provided by the PMOS transistors, P1 90, P2 94, P3 98, and P4 102. The gate and drain of P1 90 are coupled together and further coupled to the gate of P2 94 at the node A 106. P1 90 and P2 94 are the same type of device and are the same size. Further, the sources of P1 90 and P2 94 are coupled together at $V_{CC}$ 118. Therefore, P1 90 and P2 94 form a current mirror. Since P1 90 must conduct $I_1$, the mirror configuration causes P2 94 to likewise conduct a drain current of $I_1$.

MOS transistors P3 98 and P4 102 form a second current mirror. Once again, the gate and drain of P3 98 are coupled together and further coupled to the gate of P4 102. P3 98 and P4 102 are another matched pair. Therefore, the drain current of P3 98 is mirrored by the drain current of P4 102.

As an important feature, the drain of P3 98 is coupled to the drain of P2 94 at node B 110. As discussed above, the greater gate drive ($V_1+\Delta V$) on N2 54 creates a drain current, $I_2$, which is larger than the drain current $I_1$ of N1 50. Because P2 94 is biased to conduct only $I_1$, P3 98 will conduct the difference between $I_1$ and $I_2$. Therefore, the P3 98 current is given by $I_2-I_1$. Finally, the P3 current is simply mirrored to the output current reference as $I_2-I_1$. As shown above, the subtraction of $I_2$ from $I_1$ effectively eliminates the $V_{th}$ term from the output current, $I_{\mu Cox}$.

Figure 3:
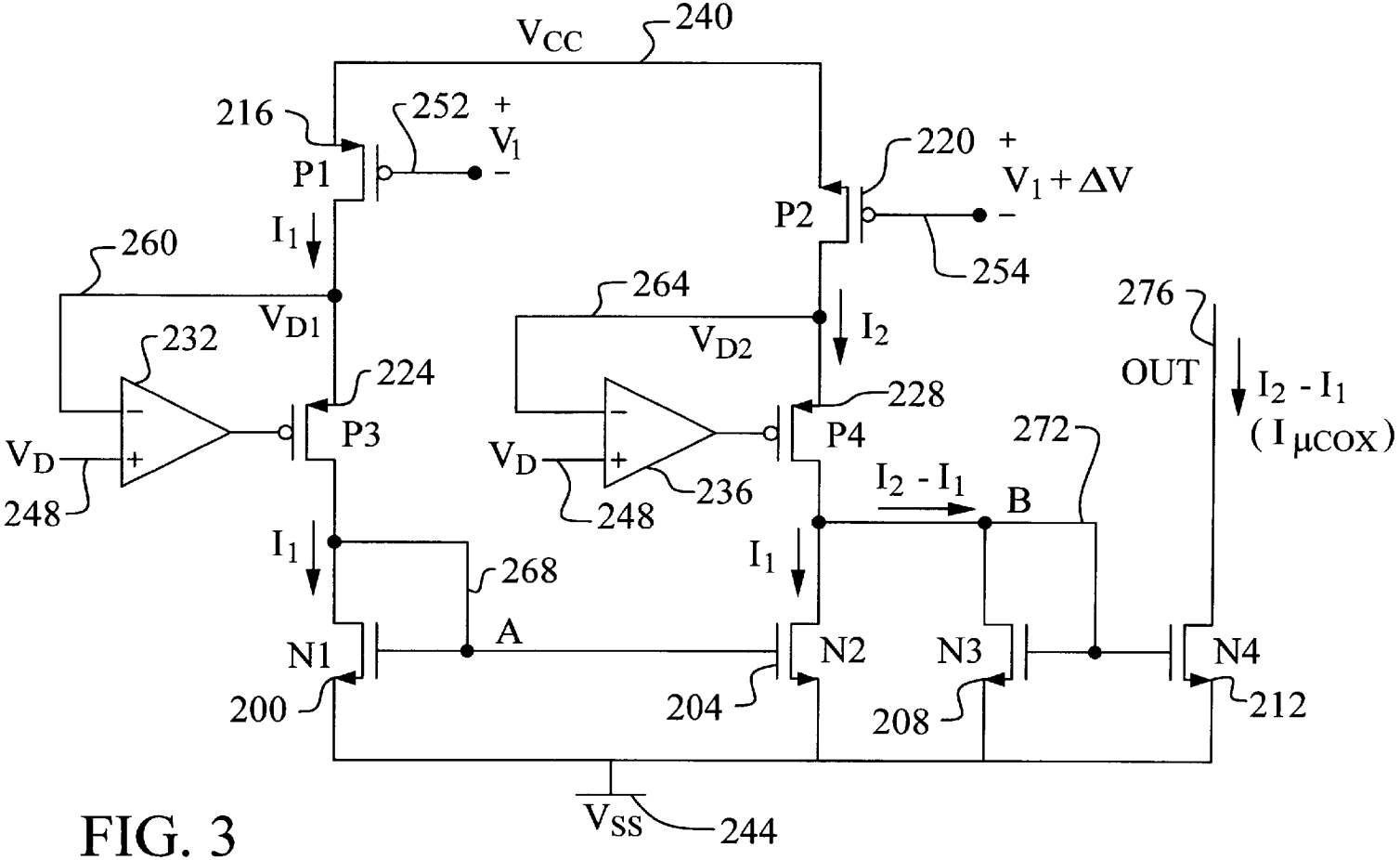
FIG. 3 illustrates the second preferred embodiment of the present invention, using PMOS transistors, including a means of forcing a drain voltage and a means of subtracting the drain currents to thereby create the current reference.

Referring now to FIG. 3, the second preferred embodiment of the present invention is illustrated. In this case, the circuit is inverted such that the main mirroring devices comprise the PMOS transistors P1 216 and P2 220. The analysis of operation of the circuit is the same as for the first embodiment of FIG. 2. In this second embodiment case of FIG. 3, the output current reference, $I_{\mu Cox}$, is a sinking current rather than a sourcing current as in FIG. 2.

Figure 4:
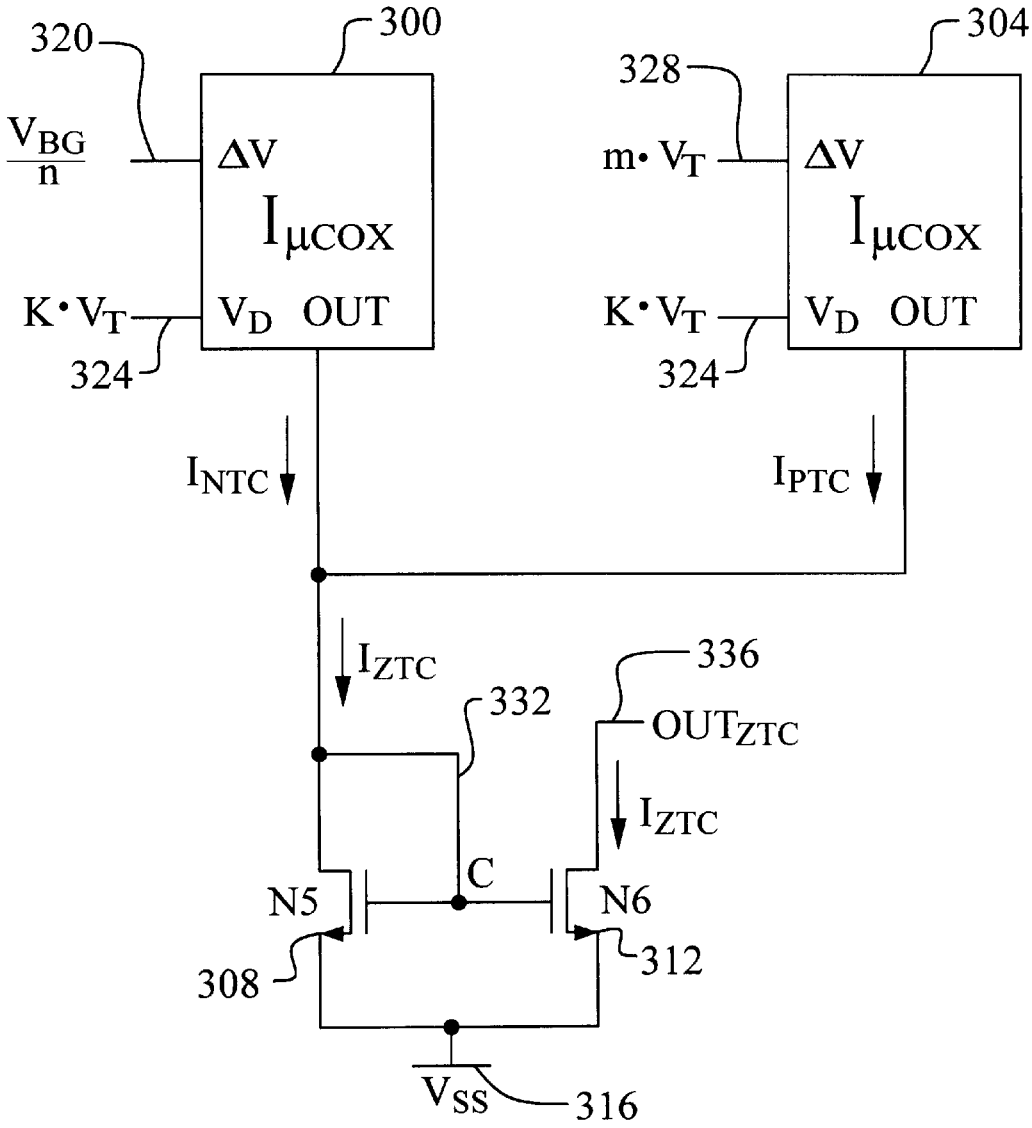
FIG. 4 illustrates the application of the present invention in a nearly zero temperature coefficient current reference circuit.

Referring now to FIG. 4, an important application of the voltage-threshold independent current reference of the present invention is illustrate. In this application, the novel circuit is used to create a nearly zero temperature coefficient (TC) current source.

First, a first voltage-threshold independent current reference 304 is used to form a positive temperature coefficient current reference circuit 304. The gate voltage for the voltage-threshold independent current reference 304 comprises a positive temperature coefficient value. The delta voltage value, ΔV 328, comprises a positive temperature coefficient value, $mV_T$ where $V_T$ is the thermal voltage and m is a constant. The drain voltage value, $V_D$ 324, comprises another positive temperature coefficient value, $kV_T$, where k is another constant.

Once again, the output of the current reference 304 is given by:

$$I_{REF}=(\mu_o C_{ox} W/L)(\Delta V)V_D.$$

Since $\Delta V=mV_T$ and $V_D=mV_T$, the reference current becomes:

$$I_{REF}=(\mu_o C_{ox} W/L)mk(V_T)^2.$$

It is known that the mobility, $\mu_o$, of the transistor varies as $(T)^{-3/2}$, where T is temperature. It is also known that $V_T$ varies as $(T)^1$. Therefore, the reference current, $I_{PTC}$, for the positive current reference 304 varies as $(T)^{1/2}$.

Second, a second voltage-threshold independent current reference 300 is used to form a negative temperature coefficient, current reference circuit 300. The gate voltage for the voltage-threshold independent current reference 300 comprises a negative temperature coefficient value. The delta voltage value, ΔV 320, comprises a negative temperature coefficient value, $V_{BG}/n$, where $V_{BG}$ is a bandgap voltage and n is a constant. The drain voltage value, $V_D$ 324, again comprises a positive temperature coefficient value, $kV_T$, where k is a constant. The current reference value output by the circuit 300 comprises a negative temperature coefficient current reference value, $I_{ZTC}$.

Referring again to the current relation, the output of the current reference 300 is given by:

$$I_{REF}=(\mu_o C_{ox} W/L)(\Delta V)V_D.$$

Since $\Delta V=(V_{BG})/n$ and $V_D=mV_T$, the reference current becomes:

$$I_{REF}=(\mu_o C_{ox} W/L)(V_{BG})/n)(V_T).$$

Once again, the mobility, $\mu_o$, of the transistor varies as $(T)^{-3/2}$, and $V_T$ varies as $(T)^1$. However, the bandgap voltage, $V_{BG})/n$ does not significantly vary with T. Therefore, the reference current, $I_{NTC}$, for the negative current reference 300 varies as $(T)^{-1/2}$.

A means is provided for adding the positive temperature coefficient current reference value, $T_{PTC}$, and the negative temperature coefficient current reference value, $I_{NTC}$, to thereby obtain a nearly zero temperature coefficient current reference, $I_{ZTC}$. The adding means preferably comprises the current mirror circuit comprising the matching devices, N5 308 and N6 312. The gate and drain of N5 308 are coupled together and further coupled to the gate of N6 312 at the node C 332. The sources of N5 308 and N6 312 are coupled together such that a common gate-to-source voltage is obtained. The drain of N5 308 is further coupled to the current reference outputs of the current reference circuits 300 and 304. The positive temperature coefficient current reference value, $I_{PTC}$, and the negative temperature coefficient current reference value, $I_{NTC}$, are added together to create the zero TC reference, $I_{ZTC}$, as the drain current of N5. This current, $I_{ZTC}$, is mirrored to the output, OUT 336, by N6.

Figure 5:
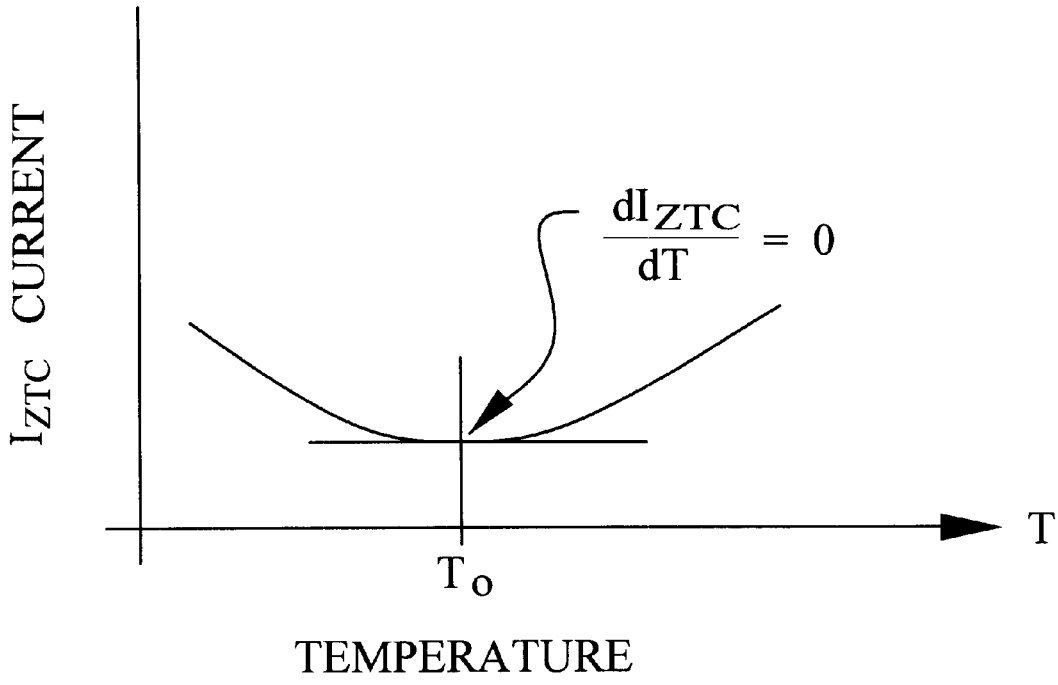
FIG. 5 illustrates the current versus temperature performance of the nearly zero temperature coefficient current reference circuit.

Referring now to FIG. 5, the temperature performance of the nearly zero TC current reference of FIG. 4 is illustrated. Note, that the combined current, $I_{ZTC}$, is given by:

$$I_{ZTC}=I_{PTC}+I_{NTC}.$$

Further, substituting into the reference equation once again, the zero TC current is given by:

$$I_{REF}=(\mu_o C_{ox} W/L)[mV_T+(V_{BG})/n)](V_T).$$

Differentiating this equation with respect to temperature and setting the result to zero results in:

$$V_{BG}/n=mV_T,$$

where temperature is $T_o$ at the zero slope point.

Referring again to FIG. 5, the response graph 350 shows how the output current source varies over temperature. The derivative zero indicates the point of zero slope at $T_o$. This is the desired operating point for the nearly zero TC circuit of FIG. 4. Further, this operating point can be selected at any fixed by setting the current and geometry of the MOS devices.

Figure 6:
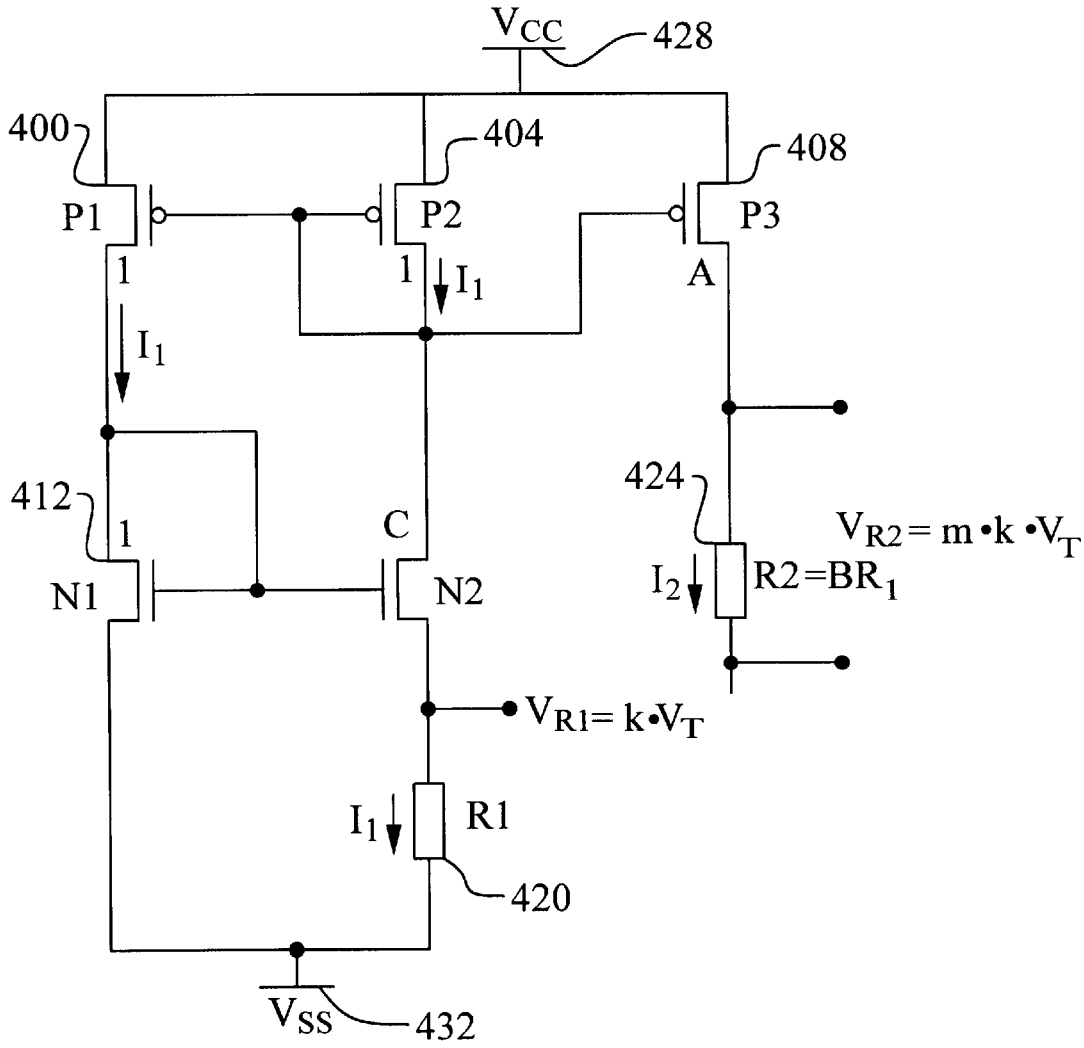
FIG. 6 illustrates an exemplary circuit for creating a positive voltage coefficient voltage depending upon the thermal voltage ($V_T$).

Referring now to FIG. 6, an exemplary circuit for deriving the $mV_T$ and $kV_T$ voltages is illustrated. This circuit is well known in the art. The current mirror created by P1 400 and P2 404 is matched such that $I_1$ is the drain current of both P1 and P2. N1 412 and N2 416 are operated in weak inversion such that the drain current is exponentially proportional to the drain voltage. Note that N2 is scaled from N1 at a ratio given by the constant C. The voltage drop across the first resistor, R1, is given by:

$$V_{R1}=ln(C)V_T.$$

Therefore, since P3 408 is scaled from P2 404 by the ratio given by the constant A, then the current flowing through the second resistor, $R_2$, is given by:

$$I_2=(Aln(C)V_T)/R_1.$$

Finally, since $R_2$ is scaled from $R_1$ by the constant B, then the voltage drop across the second resistor, $R_2$, is given by:

$$V_{R2}=ABln(C)V_T.$$

Therefore, $V_{R1}$ and $V_{R2}$ may be used for $kV_T$ and $mkV_T$.

The present invention provides a unique and advantageous current reference circuit. The unique configuration eliminates dependence on the threshold voltage to improve performance. Further, the simplicity of the scheme means that the circuits are stable, effective at low power levels, and space efficient. An effective and very manufacturable current reference circuit is achieved. The current reference circuit comprises all MOS devices. The MOS current reference circuit is not dependent upon the threshold voltage, and this reduces reference current variation due to processing variation. Finally, a nearly zero temperature coefficient current reference is achieved using this novel MOS current reference circuit.

As shown in the preferred embodiments, the novel current reference circuit provides an effective and manufacturable alternative to the prior art.

While the invention has been particularly shown and described with reference to the preferred embodiments thereof, it will be understood by those skilled in the art that various changes in form and details may be made without departing from the spirit and scope of the invention.

What is claimed is:

1. A current reference circuit comprising:

a first MOS transistor having gate, drain, and source, wherein a gate has a voltage value;

a second MOS transistor having gate, drain, and source, wherein said second MOS transistor is of the same size and type as said first MOS transistor, wherein said source is coupled to said first MOS transistor source, and wherein a delta voltage value is added to the gate voltage, a means of forcing a voltage value to said drain of said first MOS transistor and to said drain of said second MOS transistor such that said first MOS transistor and said second MOS transistor conduct drain currents in the linear mode; and a means of subtracting said first MOS transistor drain current from said second MOS transistor drain current to thereby create a current reference value wherein said current reference value does not depend upon the threshold voltage of said first and second MOS transistors.

2. The circuit according to claim 1 wherein said first and second MOS transistors comprise NMOS transistors.

3. The circuit according to claim 1 wherein said first and second MOS transistors comprise PMOS transistors.

4. The circuit according to claim 1 wherein said means of forcing a drain a voltage value to said drain to said source of said first MOS transistor and to said drain of said second MOS transistor comprises:

a first voltage follower comprising:

a first operational amplifier having positive input, negative input, and output, wherein said positive input is coupled to said voltage value and wherein said negative input is coupled to said first MOS transistor drain; and a third MOS transistor having gate, drain, and source, wherein said gate is coupled to said first operational amplifier output and wherein said source is coupled to said first MOS transistor drain such that said voltage value is forced onto said first MOS transistor drain; and a second voltage follower comprising:

a second operational amplifier having positive input, negative input, and output, wherein said positive input is coupled to said voltage value and wherein said negative input is coupled to said second MOS transistor drain; and a fourth MOS transistor having gate, drain, and source, wherein said gate is coupled to said second operational amplifier output and wherein said source is coupled to said second MOS transistor drain such that said voltage value is forced onto said second MOS transistor drain.

5. The circuit according to claim 4 wherein said first, second, third, and fourth MOS transistors comprise NMOS transistors.

6. The circuit according to claim 4 wherein said first, second, third, and fourth MOS transistors comprise PMOS transistors.

7. The circuit according to claim 1 wherein said means of subtracting said first MOS transistor drain current from said second MOS transistor drain current to thereby create a current reference value comprises:

a fifth MOS transistor having gate, drain, and source, wherein said gate and said drain are coupled together and are further coupled to said first MOS transistor drain such that said fifth MOS transistor conducts a drain current equal to said first MOS transistor drain current;

a sixth MOS transistor having gate, drain, and source, wherein said source is coupled to said fifth MOS transistor source, wherein said drain is coupled to said second MOS transistor, and wherein said gate is coupled to said fifth MOS transistor gate such that said sixth MOS transistor conducts a drain current equal to said first MOS transistor drain current;

a seventh MOS transistor having gate, drain, and source, wherein said drain and said gate are coupled together and are further coupled to said second MOS transistor drain such that said seventh MOS transistor conducts a drain current equal to said second MOS transistor drain current minus said first MOS transistor drain current; and an eighth MOS transistor having gate, drain, and source, wherein said source is coupled to said seventh MOS transistor source and wherein said gate is coupled to said seventh MOS transistor gate such that said eighth MOS transistor conducts a drain current equal to said seventh MOS transistor drain current.

8. The circuit according to claim 7 wherein said first and second MOS transistors comprise NMOS transistors and said fifth, sixth, seventh, and eighth MOS transistors comprise PMOS transistors.

9. The circuit according to claim 7 wherein said first and second MOS transistors comprise PMOS transistors and said fifth, sixth, seventh, and eighth MOS transistors comprise NMOS transistors.

10. A current reference circuit comprising:

a first MOS transistor having gate, drain, and source, wherein a gate has a voltage value, a second MOS transistor having gate, drain, and source, wherein said second MOS transistor is of the same size and type as said first MOS transistor, wherein said source is coupled to said first MOS transistor source, and wherein a delta voltage value is added to the gate voltage, a means of forcing a voltage value to said drain of said first MOS transistor and to said drain of said second MOS transistor such that said first MOS transistor and said second MOS transistor conduct drain currents in the linear mode, said means of forcing comprising:

a first voltage follower comprising:

a first operational amplifier having positive input, negative input, and output, wherein said positive input is coupled to said voltage value and wherein said negative input is coupled to said first MOS transistor drain; and a third MOS transistor having gate, drain, and source, wherein said gate is coupled to said first operational amplifier output and wherein said source is coupled to said first MOS transistor drain such that said voltage value is forced onto said first MOS transistor drain; and a second voltage follower comprising:

a second operational amplifier having positive input, negative input, and output, wherein said positive input is coupled to said voltage value and wherein said negative input is coupled to said second MOS transistor drain; and a fourth MOS transistor having gate, drain, and source, wherein said gate is coupled to said second operational amplifier output and wherein said source is coupled to said second MOS transistor drain such that said voltage value is forced onto said second MOS transistor drain; and a means of subtracting said first MOS transistor drain current from said second MOS transistor drain current to thereby create a current reference value wherein said current reference value does not depend upon the threshold voltage of said first and second MOS transistors, said means of subtracting comprising:

a fifth MOS transistor having gate, drain, and source, wherein said gate and said drain are coupled together and are further coupled to said first MOS transistor drain such that said fifth MOS transistor conducts a drain current equal to said first MOS transistor drain current;

a sixth MOS transistor having gate, drain, and source, wherein said source is coupled to said fifth MOS transistor source, wherein said drain is coupled to said second MOS transistor, and wherein said gate is coupled to said fifth MOS transistor gate such that said sixth MOS transistor conducts a drain current equal to said first MOS transistor drain current;

a seventh MOS transistor having gate, drain, and source, wherein said drain and said gate are coupled together and are further coupled to said second MOS transistor drain such that said seventh MOS transistor conducts a drain current equal to said second MOS transistor drain current minus said first MOS transistor drain current; and an eighth MOS transistor having gate, drain, and source, wherein said source is coupled to said seventh MOS transistor source and wherein said gate is coupled to said seventh MOS transistor gate such that said eighth MOS transistor conducts a drain current equal to said seventh MOS transistor drain current.

11. The circuit according to claim 10 wherein said first, second, third, and fourth MOS transistors comprise NMOS transistors and said fifth, sixth, seventh, and eighth MOS transistors comprise PMOS transistors.

12. The circuit according to claim 10 wherein said first, second, third, and fourth MOS transistors comprise PMOS transistors and said fifth, sixth, seventh, and eighth MOS transistors comprise NMOS transistors.

* * * * *